United States Patent [19]

Hogue

[11] Patent Number: 4,482,943

[45] Date of Patent: Nov. 13, 1984

[54] TEMPERED GLASS GLOBE

[75] Inventor: Marcus P. Hogue, Hendersonville, N.C.

[73] Assignee: General Electric Company, Schenectady, N.Y.

[21] Appl. No.: 564,117

[22] Filed: Dec. 21, 1983

[51] Int. Cl.[3] ..... F21S 1/10

[52] U.S. Cl. ..... 362/363; 362/267; 362/311; 362/355; 362/361; 362/375; 362/457

[58] Field of Search ..... 362/267, 311, 355, 361, 362/363, 375, 457

[56] References Cited

U.S. PATENT DOCUMENTS 3,191,021 6/1965 Berry et al. ..... 362/363

3,675,007 7/1972 Appleton et al. ..... 362/363

*Primary Examiner*—Stephen J. Lechert, Jr.

*Attorney, Agent, or Firm*—Ernest W. Legree; Philip L. Schlamp; Fred Jacob

[57] ABSTRACT

A tempered glass globe for a hazardous location luminaire comprises a bowl portion and a flaring rim portion with the walls substantially uniform in thickness in both portions. The rim portion makes an angle of taper with the vertical in the range of 15° to 45° and defines a section of a conical surface for making a nonflame-propagating joint with a mating conical surface in a globe ring. The outside of the flared rim may be ground for sealing directly to an accurately machined metal surface.

6 Claims, 5 Drawing Figures

6
5
3
2
1
4

TEMPERED GLASS GLOBE

The invention relates to a tempered glass globe intended to form part of a hazardous location lighting fixture or luminaire.

BACKGROUND OF THE INVENTION

A luminaire or lighting fixture is a mechanical assembly of parts which must be capable of disassembly for lamp replacement, and in practice it is impossible to have it perfectly hermetically sealed. Therefore, it is accepted that even with hazardous location luminaires, any ambient gas will in time find its way into the luminaire. Lighting fixtures listed by Underwriters Laboratories (UL) as suitable for use in hazardous locations in which combustible gases or vapors are present (Class 1, Division 1), are required to have enclosures for the electrical components having sufficient strength to withstand the explosion pressure should there be an electrical or other malfunction that ignites the gases inside. Furthermore, as the momentary pressure from the explosion inside relieves itself to the outside, the ignited gases must be cooled sufficiently as they exit that explosive gases on the outside are not ignited, such quality being commonly referred to as nonflame propagation through the joints.

The lamp or light source proper within the luminaire may be either a filament or an inner arc tube in the case of a high intensity discharge (HID) lamp. In either case the lamp envelope operates at a very high temperature and usually is merely thin (1 mm) and relatively fragile glass. Accordingly, a globe is needed to surround and shield the lamp envelope from damage while permitting the light to pass out. The globe also serves to keep ignitable gases or other combustible material away from the high temperature surface of the lamp envelope itself.

The globe is usually made of pressed glass at least ¼ inch thick and in order for the globe to safely accomplish its functions, the glass needs to be tempered. Tempering as applied to glass is a process that entails first heating the material uniformly to a temperature adequate to relax internal stresses but permitting handling without deformation. The glass is then rapidly quenched by extracting heat from both surfaces at rates generating a symmetrical temperature profile across its thickness. This is continued until the hottest point on the profile is below the effective solidification temperature. Finally the glass is cooled to room temperature, and in such final cooling, the contraction of the relatively hot core is resisted by the cool surface layers. The result is a generally parabolic stress distribution across the thickness of the glass; compression near the surface is balanced by tension in the interior, and the maximum tensile stress is about half the compressive stress at the surface.

Glass fractures when its tensile strength is exceeded and it is the outer surface that is vulnerable. The term "outer" is used with reference to the glass itself and in a bowl, both inside and outside are "outer" surfaces. With tempered glass, an external force such as a blow that would put an outer surface in tension must first neutralize the compressive prestress before any net tensile stress can develop at the surface, and thus breaking strength is enhanced. When tempered glass is broken, the strain energy reduces the glass into harmless small fragments more or less cubic in shape.

In a globe for a hazardous area luminaire, the desideratum is to have the breaking strength as high as possible. However, increasing the wall thickness or the degree of tempering does not necessarily improve the breaking strength and may, in fact, diminish it. The reason is that the strength of glass ultimately is limited by the maximum stress of approximately 10,000 p.s.i. that it can carry in tension. Excessive tempering produces a high tensile stress condition hidden as a weakness inside the glass and making it effectively less resistant to an external force. The presence of a stone, that is a non-homogeneous fragment in the glass having a different coefficient of expansion, may aggravate the situation. Globes having such inherent weaknesses occasionally spontaneously shatter or self-destruct, and thus present a real hazard with the possibility of disaster should there be explosive gas present in the environment at the time.

SUMMARY OF THE INVENTION

The object of the invention is to provide a glass globe for a hazardous area luminaire having greater strength together with higher reliability than prior art tempered globes, and desirably at lower cost.

In globes as made up to the present, a thickened rim was provided at the upper end, that is at the top. The rim was generally at least twice and sometimes more than twice as thick as the globe wall. It was ground flat and engaged by the flat machined underside of a clamp ring to make a nonflame-propagating joint. The rim thickness was necessary in order to have a length of path across the flat ground thickness sufficient for adequate cooling of exiting ignited gases, that is in order to avoid propagation of flame through the joint, as required by UL specifications.

I have found that the thickened rim of prior art globes is a region in which over-tempering tends to occur and for that reason it is a source of inherent weakness. In accordance with my invention, I eliminate the thickened rim and provide a tempered glass globe of substantially constant wall thickness throughout. This makes possible a more uniform cooling rate during the tempering quench cycle without special complex accommodation for alternately thin and thick globe sections. The more uniform cooling rate permits tempering uniformity and avoidance of excessive tensile stress within the glass. The rim of the constant wall thickness (CWT) globe is outwardly flared and is engaged by a collar for support of the globe. A nonflame-propagating seal or joint is preferably made with the outside surface of the flared rim but alternatively it may be made with the inside surface.

In a preferred embodiment, the tempering uniformity achieves maximum surface compression stresses of 6,000 to 7,000 p.s.i., and maximum tensile stress at the wall center of approximately 3,000 p.s.i. The upper end of the globe is outwardly flared from about 15° to 45° and a nonflame-propagating seal is made to the external surface of such flaring portion. By grinding of the flaring portion to the necessary tolerance, a direct glass to metal nonflame-propagating seal may be made.

DETAILED DESCRIPTION

Figure 1:
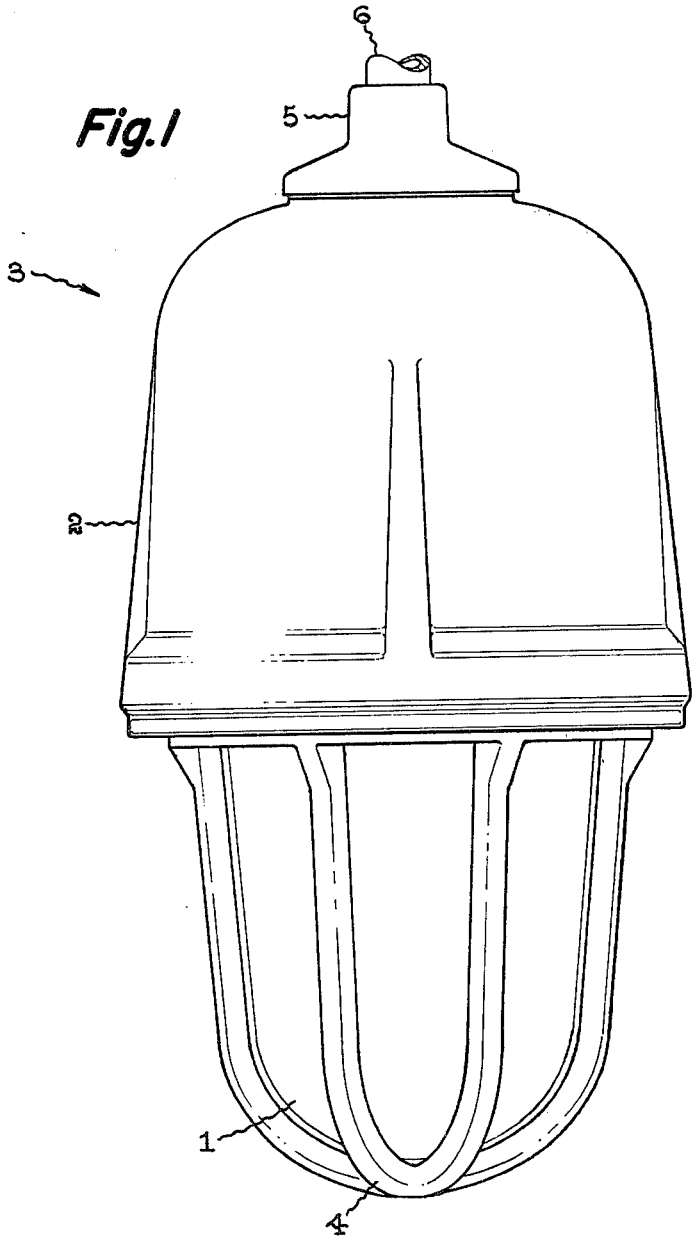
FIG. 1 illustrates a typical hazardous area luminaire whose glass globe the invention addresses.

Referring to FIG. 1, the invention addresses the glass globe 1 which forms a light-transmitting bottom closure for the bell-like metal housing 2 of a hazardous duty type luminaire or lighting fixture 3. In a luminaire operating a gaseous discharge lamp such as a high pressure sodium vapor lamp, the housing 2 would contain the electrical ballast components such as a core and coil assembly, a pulse starter, and a capacitor if used, together with a screw socket for the lamp. The socket is mounted so that the lamp (not shown) hangs down within the globe. A cage-like protective guard 4 is secured along the bottom edge of the housing and extends around the globe 1. The luminaire is supported from the top by a hub 5 which has standard pipe threads for accommodating the threaded end of a conduit 6, suitably ¾" or 1" steel pipe.

Figure 2:
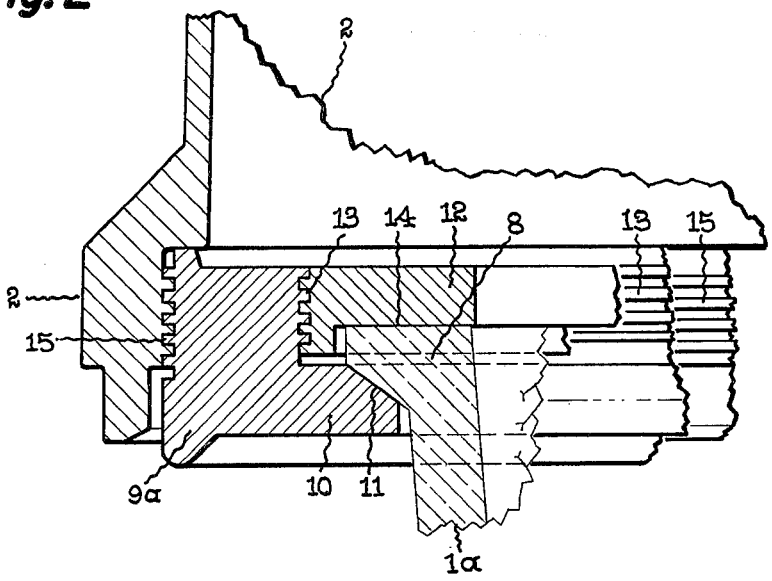
FIG. 2 is a cutout section of a prior art luminaire showing the thickened rim construction of the globe and the manner of support.

The prevalent practice in supporting the globe and achieving a nonflame-propagating venting joint with the upper housing has required a thick rim at the upper end of the globe. One prior art globe construction together with the mounting arrangement and venting joint for it is illustrated in FIG. 2. The globe 1*a* is provided with a rim portion 8 which is outwardly shouldered to such extent that the thickness of the glass in the rim is approximately double the thickness in the wall. The globe is supported by a globe ring 9*a* whose chamfered inner collar 10 engages the sloping undershoulder 11 of the rim. An inner clamp ring 12 having Acme threads 13 engaging cooperating thread on the inside of the globe ring, presses down on the globe and locks its rim down against the chamfered inner collar of the globe ring. The top surface 14 of the rim of the globe is ground flat and the underside of the clamp ring which engages it is machined flat to assure a good nonflame-propagating joint. The globe ring 9*a* attaches to the luminaire housing 2 through Acme threads 15 which engage cooperating threads on the inside of the housing. Further details on the luminaire construction are given in copending application Ser. No. 426,486, filed Sept. 29, 1982 of James L. Grindle entitled "Fixture for Hazardous Area", now U.S. Pat. No. 4,425,609.

In the prior art rimmed globe support arrangement illustrated in FIG. 2, there are three nonflame-propagating venting joints into the interior of the luminaire. They are through the Acme threads at 15 between the housing 2 and globe ring 9, through the Acme threads at 13 between the globe ring and clamp ring 12, and through the joint at 14 between the ground top surface of the globe rim and the machined underside of the clamp ring. At the engagement of the rim's undershoulder 11 by the chamfered inner collar 10 of the globe ring, the glass is not ground and there is no assurance of close conformance between the surfaces. Thus the contact or engagement with the glass surface at 11 is not a nonflame-propagating joint.

In accordance with my invention, I eliminate the thickened rim of the prior art and provide a tempered glass globe having a substantially constant wall thickness throughout its entire extent. I have found that by eliminating the thickened rim and resorting to constant wall thickness, tempering uniformity with maximum surface compressive stresses of about 6000 to 7000 p.s.i. and maximum tension stress at the wall center of about 3000 p.s.i. is readily achieved. The surface compression regions are symmetrical with a depth of about 25% on each side, leaving a central core region of about 50% of the wall thickness to carry the balancing tension stresses. Wall uniformity permits a more uniform cooling rate during the tempering quench cycle without any complications in order to accommodate a thick section.

In any pressed glass product imperfections will inevitably be present. They can result from process inclusions such as air bubbles or other gases, various tool contaminants, foreign inclusions within the glass melt itself. Foreign inclusions, usually called "stones", are small pieces of unmelted sand, refractory lining debris, or other raw material oxides whose properties, and particularly their coefficient of expansion, do not match the amorphous mixture. Wherever a "stone" is located there may be a stress concentration which depends upon the nature of the "stone" and its geometry. This concentration aggravates and increases the localized trapped stress by a "K" factor which starts at 1 and may range up as high as 20. In the outer 25% portions of the wall which are in compressive stress, "stones" can occur and are less likely to have a harmful effect. But in the central 50% which is in tensile stress, a "stone" can be very harmful. In particular, if the trapped tensile stresses are unnecessarily high because of a section which is thicker and these stresses should be aggravated by the presence of a "stone", the result could be to eliminate any margin of safety in the design and accelerate a self destruct mode of failure.

With a constant wall thickness in accordance with my invention on the other hand, the maximum designed-in tensile stress permitted anywhere is readily limited to 3,000 p.s.i. Then only stones producing stress concentrations with a "K" factor greater than 3.3 which would raise the localized tensile stress over 10,000 p.s.i. can cause potential failure. The constant wall thickness globe has achieved an improvement in reliability of at least one order of magnitude by comparison with the thickened rim globe formerly used. This permits a testing approach to qualify each globe by stress testing it to some respectable percentage—say 85%, of the ultimate stress level which it is designed to withstand, thereby weeding out any potential field failures.

Figure 3A:
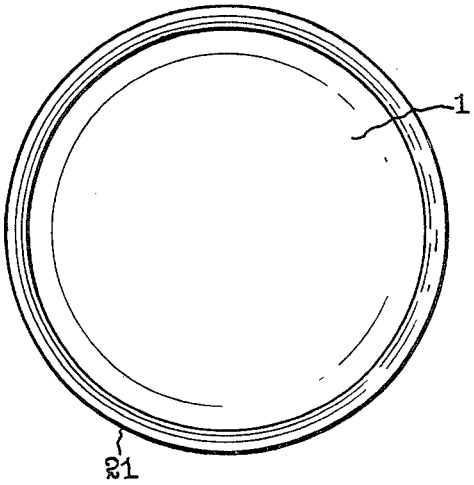
FIG. 3*a* and 3*b* are a top plan view and a vertical cross-section through a new constant wall thickness globe embodying the invention.
Figure 3B:
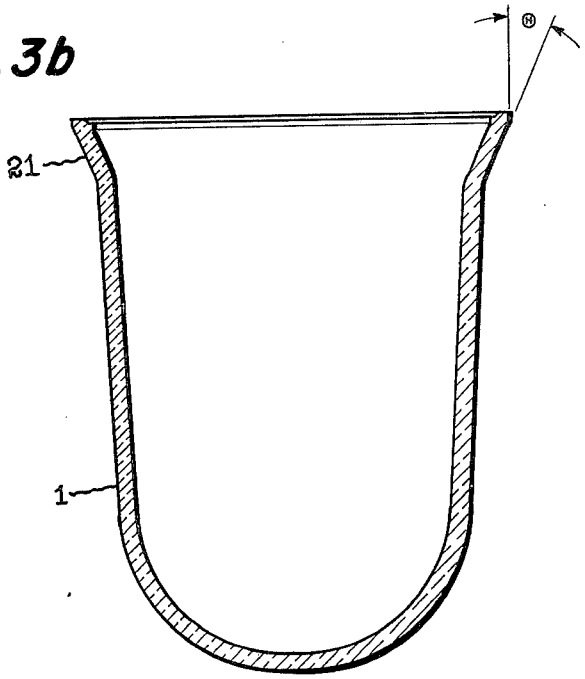

A glass to metal joint is required which will prevent passage of flame from the inside of the globe into the ambient should there be a gas ignition within the luminaire. In the preferred embodiment of my invention illustrated in FIGS. 3*a*, 3*b* and 4, I provide an outwardly flared rim 21 at the upper end of the globe 1, and the outside of such rim portion is engaged to support the globe, and also to make a nonflame-propagating joint with a support member. As shown in FIG. 3*a*, the glass walls of the globe are substantially uniform in thickness throughout. For a typical hazardous location luminaire, a globe of soda lime glass having a wall thickness of about ⅜ inch is suitable. Such a globe pressed to the shape illustrated in FIG. 3*a* and having an overall length of about 10 inches weighs about 6 pounds.

Figure 4:
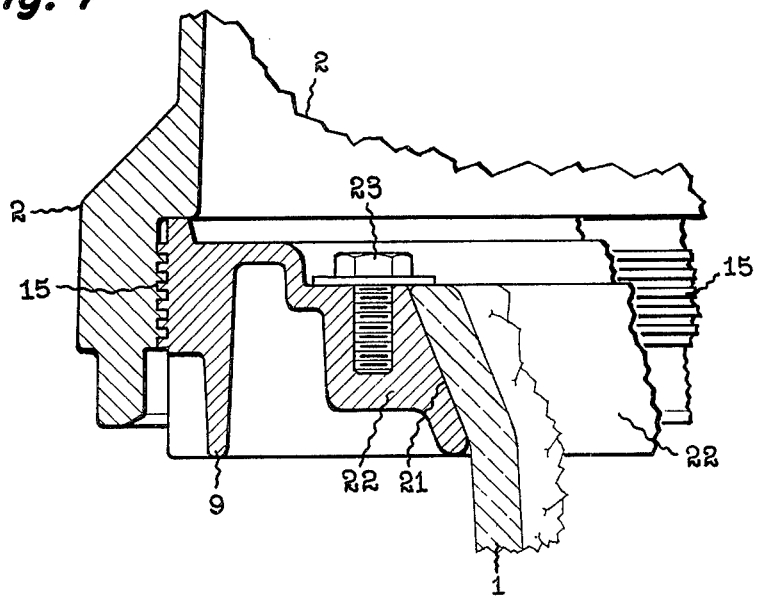
FIG. 4 is a cutout section of a luminaire using a constant wall thickness globe.

The flared rim has to support the weight of the globe at all times and must also be able to withstand the force created by an internal explosion. I have determined that the angle of taper, that is the angle $\theta$ which the flared rim makes with the vertical as indicated in FIG. 3 should be from 15° to 45°. An angle less than 15° exerts excessive peripheral pressure on the supporting collar in the event of an explosion. An angle greater than 45° results in a weaker structure where the flared rim joins the body. In the globe illustrated in the drawings, the angle $\theta$ is about 24°. The globe is supported by nesting the section of cone formed by the flared glass rim 21 in a mating cone portion 22 of predetermined slant length formed in the globe support ring 9 as shown in FIG. 4. It is held down snugly by clamping means such as several bolts and washers 23 provided around the periphery of the support ring which engage the top of the globe's flared rim. Other clamping means such as spring clips may be used instead of bolts.

For a hazardous location lighting fixture, Underwriters Laboratories specification 844 defines the standard under which a joint must be qualified by test in order to be deemed nonflame-propagating. It specifies the minimum length of the joint and the maximum clearance between surfaces at the joint, that is the maximum gap. The requirement in respect of joint or gap dimensions is related to the internal volume of the fixture and is expressed as a linear relationship between gap clearance and length of gap. For example, if the length of the joint is 1.125", a gap of 0.004" is acceptable; but if the joint is only 0.625" long, then the gap is limited to 0.0015". These dimensional requirements dictate tight tolerances and careful manufacturing to make a good joint.

In the joint between conical portion 22 of predetermined slant length and flared glass rim 21 shown in FIG. 4, the foregoing UL 844 constraints must be observed. It is not yet technically feasible to press and temper a glass globe so that the conical surface 21 is exactly true. With accurate molds and by using care in tempering it is possible to form the outside conical surface of the glass globe to within an indicator runout limit of 0.005". For production, a runout limit of 0.010" is feasible and thereafter the conical surface 21 may be ground to the extent needed to comply with the UL 844 requirement. Grinding may be effected by chucking the globe in a glass lathe and using a diamond tool bit to contact the glass.

By way of example, the UL 844 requirement may be complied with by having a joint length of 1 inch and a gap clearance not exceeding 0.003" between surfaces 22, 21 in FIG. 4. If one assumes an out of true departure of 0.010" in the flared rim of a tempered glass globe having a wall thickness of $\frac{3}{8}$" or 0.375", grinding off 0.007" to make it true within 0.003" will remove less than 8% of the outer 25% of the wall thickness which is in compression. It is seen that the increase in compressive stress within the outer portion of the wall which remains untouched by the grinding is quite minor. At the same time the benefits of greater strength and enhanced reliability resulting from constant wall thickness in a tempered globe are realized. It will be appreciated that an additional benefit of having the nonflame-propagating joint on the outside of the flared rim is the avoidance of the need for the clamp ring 12 used by the prior art and the nonflame-propagating venting joint through the Acme threads at 13 between the globe ring and the clamp ring (FIG. 2).

While the invention has been described with reference to a particular tempered glass globe embodying it, numerous modifications may be made without departing from the true spirit and scope of the invention and I intend by the appended claims to cover all such equivalent variations.

What I claim as new and desire to secure by Letters Patent of the United States is:

1. A tempered glass globe comprising a glass vessel having a bowl portion merging into a flaring rim portion which is circular in cross-section,
   the walls of said globe being at least $\frac{1}{4}$ inch thick and substantially uniform in thickness throughout both portions,
   said rim portion making an angle of taper with the vertical in the range of 15° to 45°,
   said rim portion defining a section of a conical surface for making a nonflame-propagating joint with a member having a mating conical surface.

2. A globe as in claim 1 wherein the outside of said rim portion defines said section of a conical surface for nesting and making a nonflame-propagating joint with a support member having a mating conical surface.

3. A globe as in claim 2 wherein the outside of said rim portion is ground sufficiently true to a perfect conical surface over said section to make a nonflame-propagating joint with the accurately machined surface of a mating conical member in which it is adapted to nest.

4. An assembly of a tempered glass globe with a globe ring for a hazardous location luminaire comprising;
   a tempered glass globe having a bowl portion merging into a flaring rim portion, said rim portion being substantially circular in cross-section, the walls of said globe being at least $\frac{1}{4}$ inch thick and substantially uniform in thickness throughout both portions,
   said rim portion marking an angle of taper with the vertical in the range of 15° to 45° and defining a section of a conical surface,
   and a globe ring for supporting said globe and fastening it to a luminaire housing, said globe ring comprising a disc-like metal body having a central conical aperture of predetermined slant length for accommodating said flaring rim portion and making a nonflame-propagating joint therewith.

5. An assembly as in claim 4 including clamping means located around the rim of said globe holding the globe snugly in said globe ring.

6. A luminaire comprising the assembly defined in claim 4 and a bell-like metal housing, said globe ring having a threaded periphery engaging mating threads on the inside of said housing at its lower edge.

* * * * *